US005895102A

United States Patent [19]

Fleisch

[11] Patent Number: 5,895,102

[45] Date of Patent: Apr. 20, 1999

[54] DRAWER SLIDE

[75] Inventor: Walter Fleisch, Lustenau, Austria

[73] Assignee: Alfit Aktiengesellschaft, Götzis, Austria

[21] Appl. No.: 08/847,663

[22] Filed: Apr. 22, 1997

[30] Foreign Application Priority Data

May 7, 1994 [AT] Austria ..... 811/96

[51] Int. Cl.[6] ..... A47B 88/00

[52] U.S. Cl. ..... 312/334.6; 312/334.15; 312/334.12; 312/334.19

[58] Field of Search ..... 312/334.12, 334.18, 312/334.19, 334.21, 334.41, 334.42, 331, 334.33, 334.6, 334.14, 334.15, 334.39, 334.45; 384/19

[56] References Cited

U.S. PATENT DOCUMENTS

| | | | |
|---|---|---|---|
| 1,178,877 | 4/1916 | Schaffert | 312/334.19 |
| 2,575,566 | 11/1951 | Shand | 312/334.19 X |

FOREIGN PATENT DOCUMENTS

| | | | |
|---|---|---|---|
| 0 546 201 | 6/1993 | European Pat. Off. | 312/334.12 |
| 29 08 336 | 10/1979 | Germany | 312/331 |
| 29 46 113 | 5/1981 | Germany . | |
| 94 13 108 | 2/1995 | Germany . | |
| 195282 | 5/1938 | Switzerland | 312/334.12 |
| 240433 | 4/1946 | Switzerland | 312/334.12 |

*Primary Examiner*—Milton Nelson, Jr.
*Assistant Examiner*—Janet M. Wilkens
*Attorney, Agent, or Firm*—Collard & Roe, P.C.

[57] ABSTRACT

There is described a sliding drawer guide comprising a u-shaped guide rail (1), and a drawer rail (8) which is supported on a track roller (7) in the front end portion of the guide rail (1), and in the rear end portion carries a track roller (11) rolling on a lower guiding web of the guide rail (1). A pivoted supporting lever (13) extends beyond the rear wall of a drawer (5). A guide bracket (21) is provided in a rear end portion of the mounting flange of the guide rail (1) for the supporting lever (13), which can be swivelled between an upper rest position and a lower, stop-limited working position, and carries at its free end a guiding member (24) engaging in the guide bracket (21). Furthermore, a supporting roller (18) cooperates with an upper guiding web of the guide rail (1). To create advantageous constructional conditions, it is proposed that the drawer rail (8) provided on the bottom surface of the drawer (5) extends inside the guide rail (1), whose outer leg (2) forms the mounting flange, and whose web (12) connecting the outer and the inner leg (2, 3) forms the lower guiding web, whereas the upper guiding web consists of a marginal web (19) of the inner leg (3) of the guide rail (1), which is angled with respect to the mounting flange, on which marginal web the track roller (7) for the drawer rail (8) is supported.

11 Claims, 6 Drawing Sheets

DRAWER SLIDE

BACKGROUND OF THE INVENTION

1. Field of the Invention

The present invention relates to sliding drawer guide comprising a guide rail substantially forming a U-section, a drawer rail which is supported on a track roller in the front end portion of the guide rail and in the rear end portion carriers a track roller rolling on a lower guiding web of the guide rail, and can be prolonged by a pivoted supporting lever beyond the rear wall of the drawer, as well as a guide bracket provided in the rear end portion of the mounting flange of the guide rail for the supporting lever. The lever can be swivelled between an upper rest position and a lower, stop-limited working position, and in the vicinity of its free end accommodates a guiding member engaging in the guide bracket and a supporting roller coopering with an upper guiding web of the guide rail.

2. Description of the Prior Art

To be able to fully draw out the drawers without having to provide an intermediate rail between the guide rail and the drawer rail of a sliding drawer guide, it is known (DE-29 46 113A1) to pivotally mount in the rear end portion of the drawer rail a supporting lever which can be swivelled from an upper rest position into a lower, stop-limited working position, so that the drawer rail is prolonged by this supporting lever when the drawer is drawn out. Since the supporting lever may carry a supporting roller in the vicinity of its free end, and the drawer rail may carry a track roller in its rear end portion, the drawer rail may be guided between the two legs of the guide rail U-shaped in cross-section, which legs form an upper and a lower guiding web for the supporting roller and the track roller, where the web connecting the two legs constitutes a mounting flange. The drawer rail Z-shaped in cross-section additionally rests on a track roller supported in the front end portion of the guide rail above the upper guiding web, which track roller takes away part of the weight of the drawer. By means of the rear track roller of the drawer rail the remaining load is carried away to the guide rail, as long as the center of gravity of the drawer lies behind the track roller of the guide rail. When upon drawing out the drawer, the center of gravity of the drawer is shifted by means of the track roller of the guide rail, the supporting roller of the supporting lever resting against the upper guiding web prevents the drawer from tilting, which can thus be drawn out until the track roller of the drawer rail reaches the end of the guide rail. Since the track roller of the guide rail is disposed above the upper guiding web, the two track rollers of the guide rail and the drawer rail can lie one above the other, when the drawer has been fully drawn out. To ensure that the supporting lever can be swung up from its working position into the rest position when the drawer is pushed in, the guide rail constitutes a guide bracket for the supporting lever in the rear portion of the mounting flange prolonged beyond the upper guiding web, which supporting lever engages into the guide bracket by means of a guiding pin laterally protruding against the guide bracket. The main disadvantage of this known drawer slide is the fact that due to the guide rail extending laterally beside the drawer, a comparatively large gap must be provided between the side walls of the drawer and the inner wall of the cabinet, so that the possible drawer width is limited. In addition, the fastening screws for the guide rail are disposed between the two guiding webs, so that there is a risk that in the case of an inclined fastening screw or a fastening screw not fully screwed in, the head thereof might protrude into the path of movement of the track roller or the supporting roller of the drawer rail.

To achieve a large drawer width it is already known (DE 94 13 108 U1) to provide the guide rail below the drawer between the front and the rear face wall of the cabinet, and to dispose the drawer rail on the bottom surface of the drawer beside the guide rail. Apart from the fact that with this known construction a significant torsional stress is applied onto the rails, such sliding drawer guide does not allow to fully draw out a drawer, as the rear track roller of the drawer rail must not be moved up to the front track roller of the guide rail, so as to prevent the drawer form tilting forward.

SUMMARY OF THE INVENTION

It is therefore the object of the invention to develop a sliding drawer guide as described above with simple constructive means such that a maximum drawer width can be ensured. In addition, the performance of the sliding drawer guide should not be impaired by an improper guide rail attachment.

This object is solved by the invention in that the drawer rail provided in a manner known per se on the bottom surface of the drawer at least extends substantially inside the guide rail, which with its outer leg constitutes the mounting flange and with its web connecting the outer and the inner leg constitutes the lower guiding web, whereas the upper guiding web consists of a marginal web of the inner leg of the guide rail, which is angled with respect to the mounting flange, and on which the track roller for the drawer rail is supported.

Since as a result of these measures the drawer rail may be provided on the bottom surface of the drawer, despite the attachment of the guide rail on the inner side wall of the cabinet, the lateral distance between drawer and inner cabinet wall may be kept small, because the track roller and the supporting roller are disposed below the drawer, and the lateral distance between drawer and inner cabinet wall should merely be large enough to accommodate the guide bracket which may be kept comparatively narrow. The overall height of the sliding drawer guide below the drawer is essentially determined by the diameter of the track rollers. The track and supporting rollers associated to the individual rails should merely be bridged by a web of the respective other rail. Due to the arrangement of the track roller of the guide rail on the side of the inner leg facing the mounting flange, which inner leg together with an angled marginal web forms the upper guiding web at least for the supporting roller of the supporting lever, these rollers are disposed one behind the other in pull-out direction substantially without lateral displacement, so that there are no torsional loads acting on the rails. In the case of commonly used drawers with lateral walls protruding downwards beyond the bottom, there is in addition achieved an advantageous arrangement of these rollers adjacent the bottom behind the side walls. Finally, it should be noted that with the arrangement of the track and supporting rollers adjacent the inner leg of the guide rail, the fastening screws for the mounting flange formed by the outer leg cannot impair the pull-out movement, even if their heads protrude beyond the mounting flange.

To be able to push in and draw out the drawer as smoothly as possible even in the vicinity of the guide bracket, the supporting lever may be loaded by a spring so as to swing it up. This spring loading on the one hand provides a counterweight for the lever and on the other hand supports the retraction of the drawer into the closed position. In addition, this spring loading secures the rest position of the supporting lever when the drawer rail is introduced into the guide rail, which accordingly should merely have an inlet opening adapted to the track roller of the drawer rail. In such a case it should, however, be ensured that the guiding member of the supporting lever engages into the guide bracket when the drawer is inserted. For this purpose, the guide bracket can have a preceding gripping guide for the guiding member verging into the guide bracket, which is disposed in the upper portion of the guiding member of the supporting lever swung up, so that when the drawer is subsequently drawn out, the supporting lever is properly swung down into the stop-limited working position by means of the guiding member engaging into the guide bracket, so as to be moved exclusively along the guide bracket when the drawer is repeatedly pushed in. Particularly simple constructional conditions are obtained in this connection when the gripping guide opposite the guide bracket protrudes against the drawer. When the drawer is inserted, the guiding member of the supporting lever is first of all moved past this gripping guide by making use of an elastic behavior observed for instance when the supporting lever is swung up, so as to be moved along the gripping guide against the guide bracket when the drawer is drawn out, and to be introduced into the same as a result of the still existing residual spring action.

To prevent the guiding member of the supporting lever from escaping from the guide bracket in upward direction, as this would be the case in the overhead transport of the cabinet, the guide bracket may be provided at its end with a stop for the guiding member of the supporting lever. The guiding member for the guide bracket may advantageously consist of a guiding roller, which protrudes against the guide bracket and can be encompassed by the guide bracket, which due to this engagement by the guide bracket cannot slide away from the guide bracket. A favorable embodiment is in this connection also achieved in that the conical guiding roller is supported in the supporting lever with a downward inclination with respect to the mounting flange of the guide rail. For guiding such a conical, inclined guiding roller, the guide bracket may have a guiding surface extending with an inclination adapted in cross-section. Apart from this, such guiding roller provides an advantageous stopping surface, so that upon insertion of the drawer the guiding roller is moved past the gripping guide of the guide bracket due to the inherent elasticity of the supporting lever or a corresponding spring loading.

The support of the supporting lever can advantageously be effected in an end piece, which is connected with the drawer rail and at the same time carries the track roller of the drawer rail. When providing such end piece, the pivotal mounting of the supporting lever may be neglected in the constructive design of the drawer rail. The drawer rail as well as the guide rail can thus also be utilized for simple drawers, in particular when the guide bracket constitutes a component separate from the guide rail, but connectable with the guide rail. To be able to use the rear wall of the drawer for accommodating the occurring loads, the end piece can additionally be mounted on the rear wall of the drawer.

To prevent the drawer rail from being lifted off from the track roller of the guide rail when the drawer is drawn out, the drawer rail can have an angled marginal web, which is engaged by a safety stop in the front end portion of the guide rail. Since a marginal web of the drawer rail cooperates with this safety stop, the lifting protection of the drawer is ensured over a wide range of the pull-out movement.

The track roller of the drawer rail can be disposed substantially without lateral displacement with respect to the track roller of the guide rail. However, this leads to a restriction of the possible pull-out length, as the track roller of the drawer rail cannot be moved past the track roller of the guide rail. When the web of the guide rail forms a path of movement for the track roller of the drawer rail, which with respect to the track roller of the guide rail is offset against the mounting flange, the track roller of the drawer rail can be moved past the track roller of the guide rail up the height thereof, which provides for a maximum pull-out length. The displacement of the track roller of the drawer rail creates no difficulties, in particular when it is supported in a separate end piece, so that the support of the track roller can be neglected in the design of the drawer rail.

Although due to the allocation of the guide bracket to the mounting leg of the guide rail, a continuous mounting leg over the length of the rail is recommended, there may also be used a construction where the mounting leg of the guide rail consists of fastening straps connected with the web.

BRIEF DESCRIPTION OF THE DRAWINGS

In the drawing, the subject-matter of the invention is represented by way of example, wherein.

DETAILED DESCRIPTION OF PREFERRED EMBODIMENTS

Figure 1:
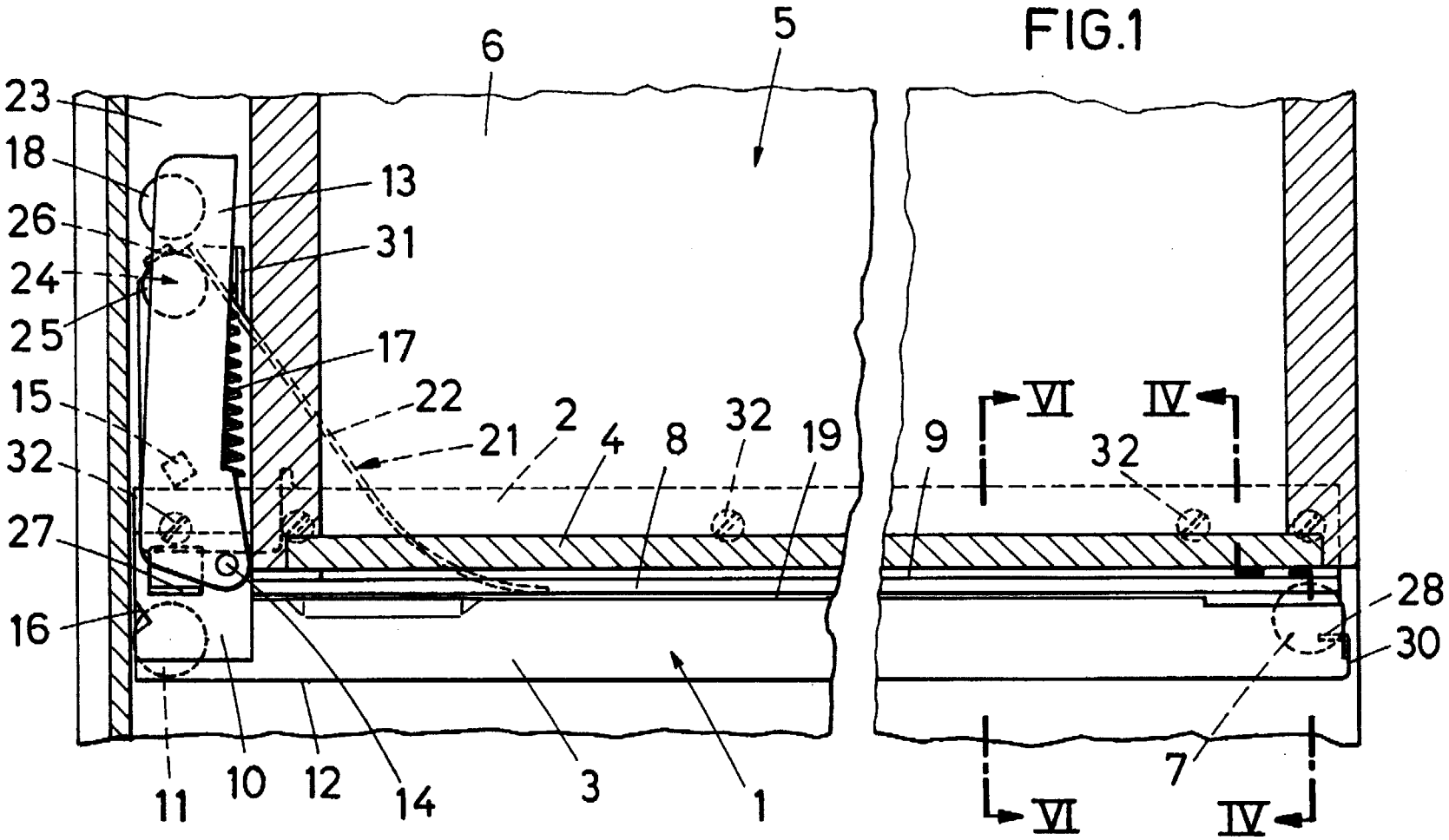
FIG. 1 illustrates a guide for a sliding drawer according to the invention in a schematic longitudinal section through the drawer.
Figure 3:
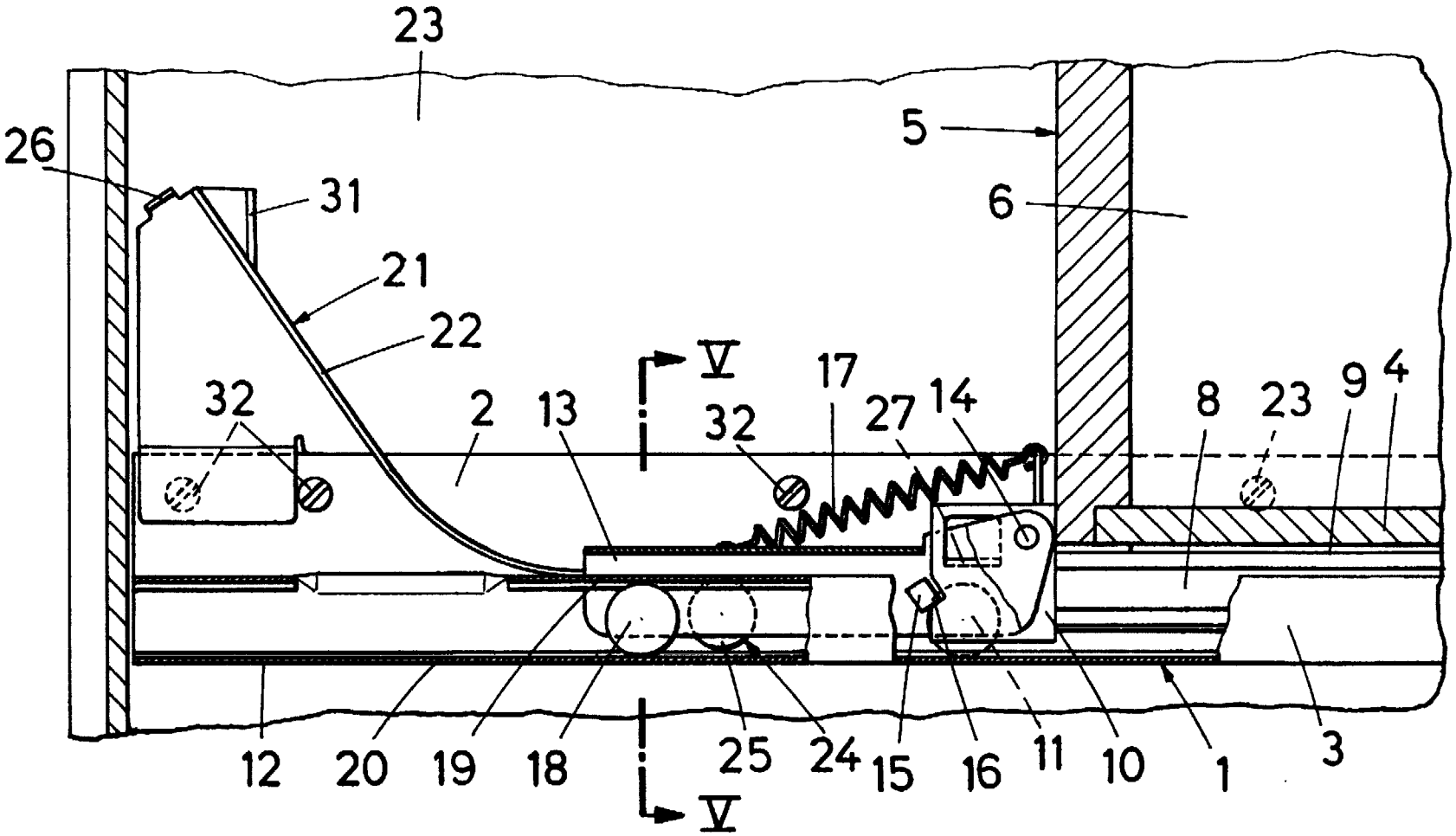
FIG. 3 illustrates the sliding drawer guide in accordance with FIG. 1 in the vicinity of the supporting lever swung down into the working position.

The illustrated guide for a sliding drawer comprises a guide rail 1 substantially forming a U-section, whose outer leg 2 constitutes a mounting flange, and whose inner leg 3 extends behind the side wall 6 protruding downwards beyond the bottom 4 of the drawer 5. In the front end portion of this inner leg 3 a track roller 7 for a drawer rail 8 is provided. The drawer rail is mounted on the underside of the drawer 5 and has a web 9 supported on the track roller 7 of the guide rail 1. In the rear end portion of this drawer rail 8 an end piece 10 is disposed, which carries a track roller 11 rolling on the web 12 of the guide rail 1, which connects the legs 2 and 3. On this end piece 10 a supporting lever 13 is pivoted about a horizontal axis 14. The supporting lever 13 can be swivelled between an upper rest position, which is represented in FIG. 1, and a lower working position (FIG. 3). The lower working position is secured by means of a stop 15, which engages in a stop recess 16 of the end piece 10. Between the end piece 10 and the supporting lever 13 a spring 17 is pivotally mounted, which is loading the supporting lever 13 so as to swing it up into the rest position. At the free end of the supporting lever 13 a supporting roller 18 is mounted, which cooperates with an upper guiding web formed by an angled marginal web 19 of the inner leg 3 of the guide rail 1. The drawer rail 8 is thus supported on the one hand by means of the front track roller 7 of the guide rail 1 and on the other hand by means of the rear track roller 11 of the drawer rail on the web 12 of the guide rail 1 and, in the working position of the supporting lever 13, by means of the supporting roller 18 on the upper marginal web 19. As long as the center of gravity of the drawer 15 lies between the track rollers 7 and 11, the supporting roller 18 of the supporting lever 13 does not exert a supporting force. Only when during the pull-out of the drawer 5 the center of gravity of the drawer is displaced beyond the front track roller 7 of the guide rail 1, and the drawer 5 is subjected to a tilting moment, which acts in the sense of lifting off the track roller 11 from the web 12 of the guide rail 1, this tilting moment is halted as the supporting roller 18 of the supporting lever 13 engages the angled marginal web 19 of the guide rial. As can in particular be seen in FIGS. 4 and 5, the track roller 7 of the guide rail 1 as well as the supporting roller 18 of the supporting lever 13 are disposed one behind the other without a substantial lateral displacement in pull-out direction, so that the rails 1 and 8 are not subjected to a torsional moment. The track roller 11 of the drawer rail 8 could roll on the web 12 of the guide rail 1 in the vicinity of the web 19 supporting roller 18. Such construction would, however, necessitate that the track roller 11 cannot be moved past the track roller 7 of the guide rail 1 up to the height thereof. For this reason, the web 12 of the guide rail 1 forms a separate web 20 for the track roller 11 offset laterally in the end piece 10 with respect to the track roller 7.

Figure 2:
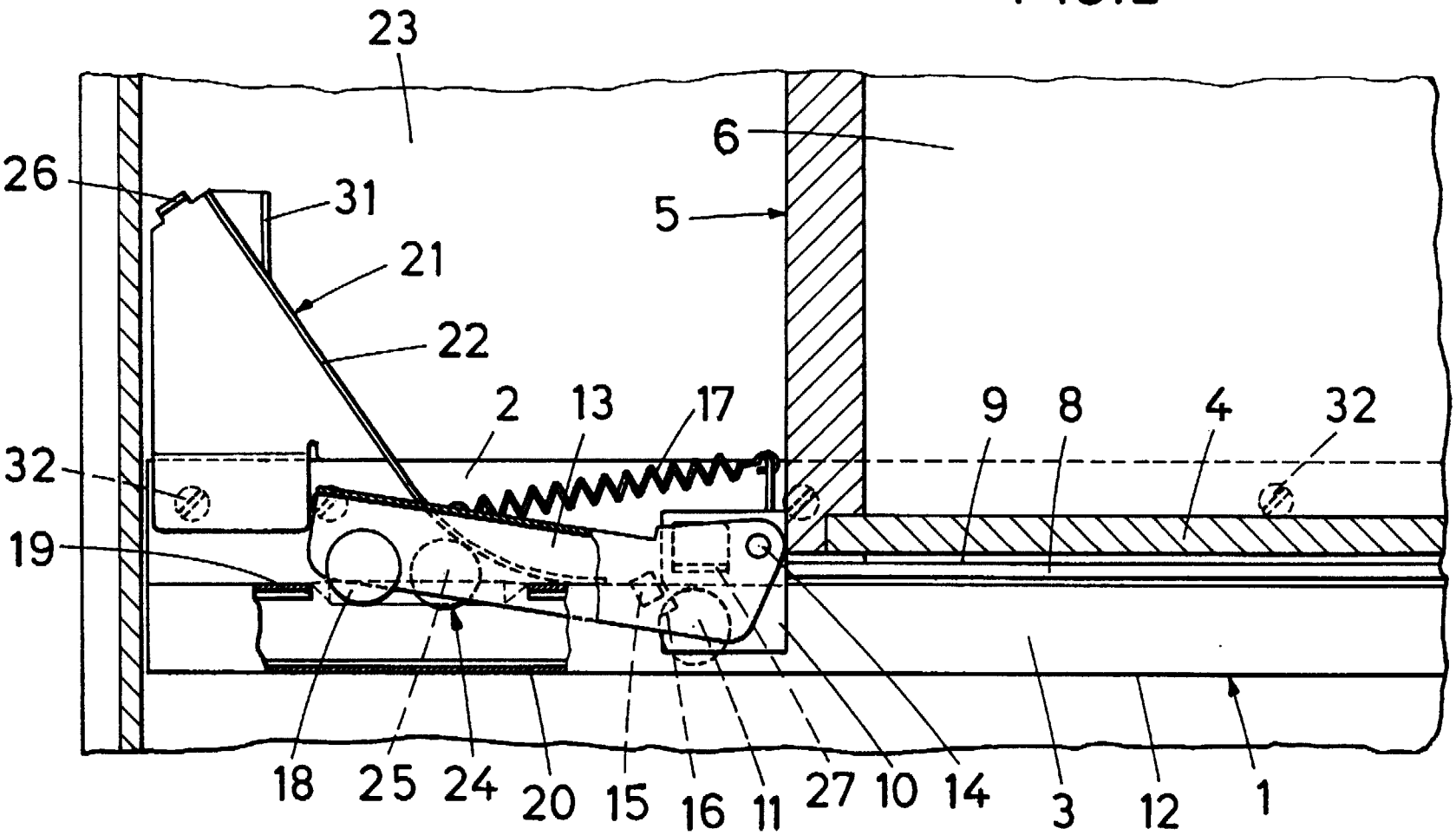
FIG. 2 illustrates the sliding drawer guide in accordance with FIG. 1 in the vicinity of the supporting lever in an intermediate position of the supporting lever.
Figure 4:
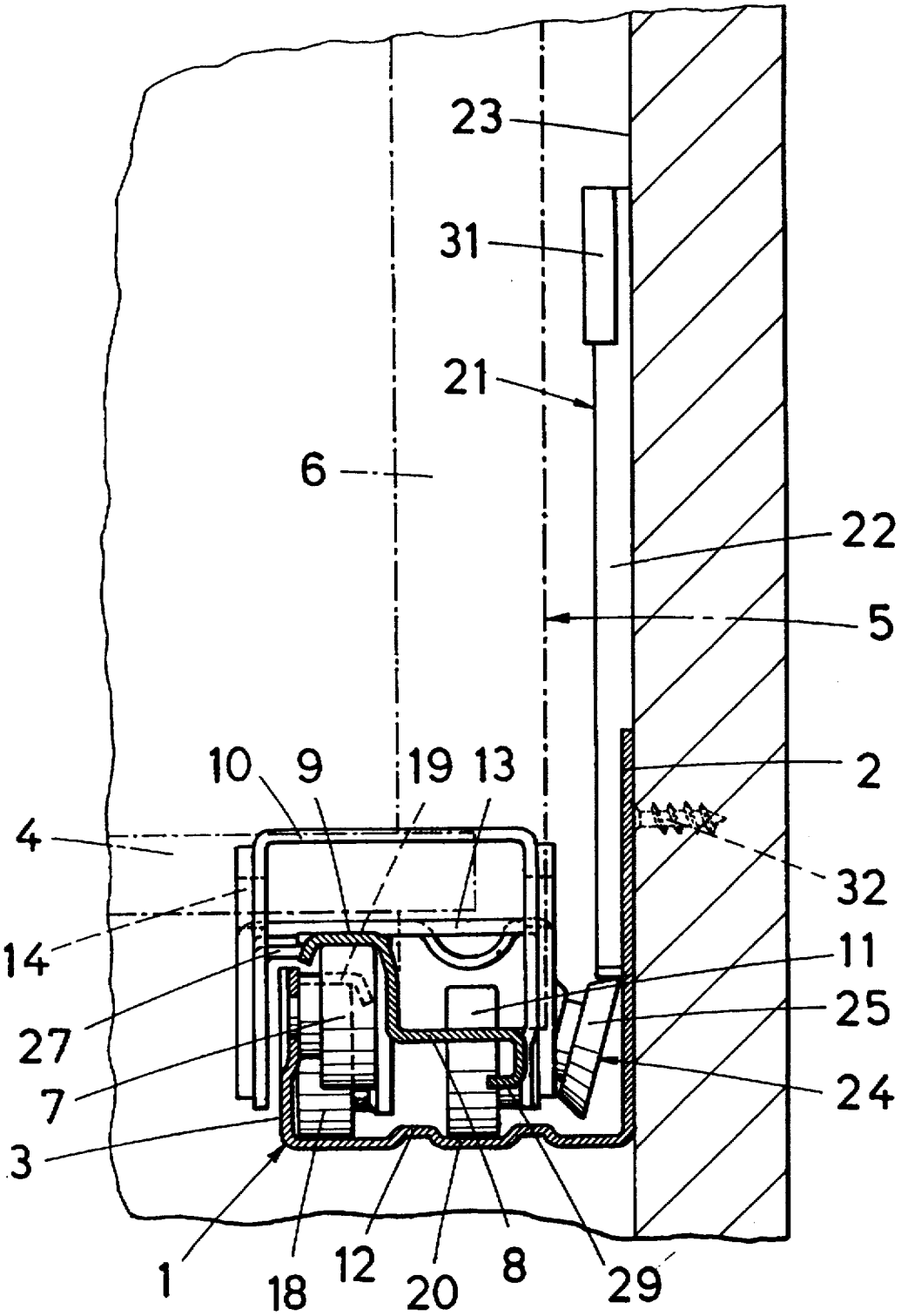
FIG. 4 illustrates a section along line IV—IV of FIG. 1, but with the supporting lever swung down, on an enlarged scale.
Figure 5:
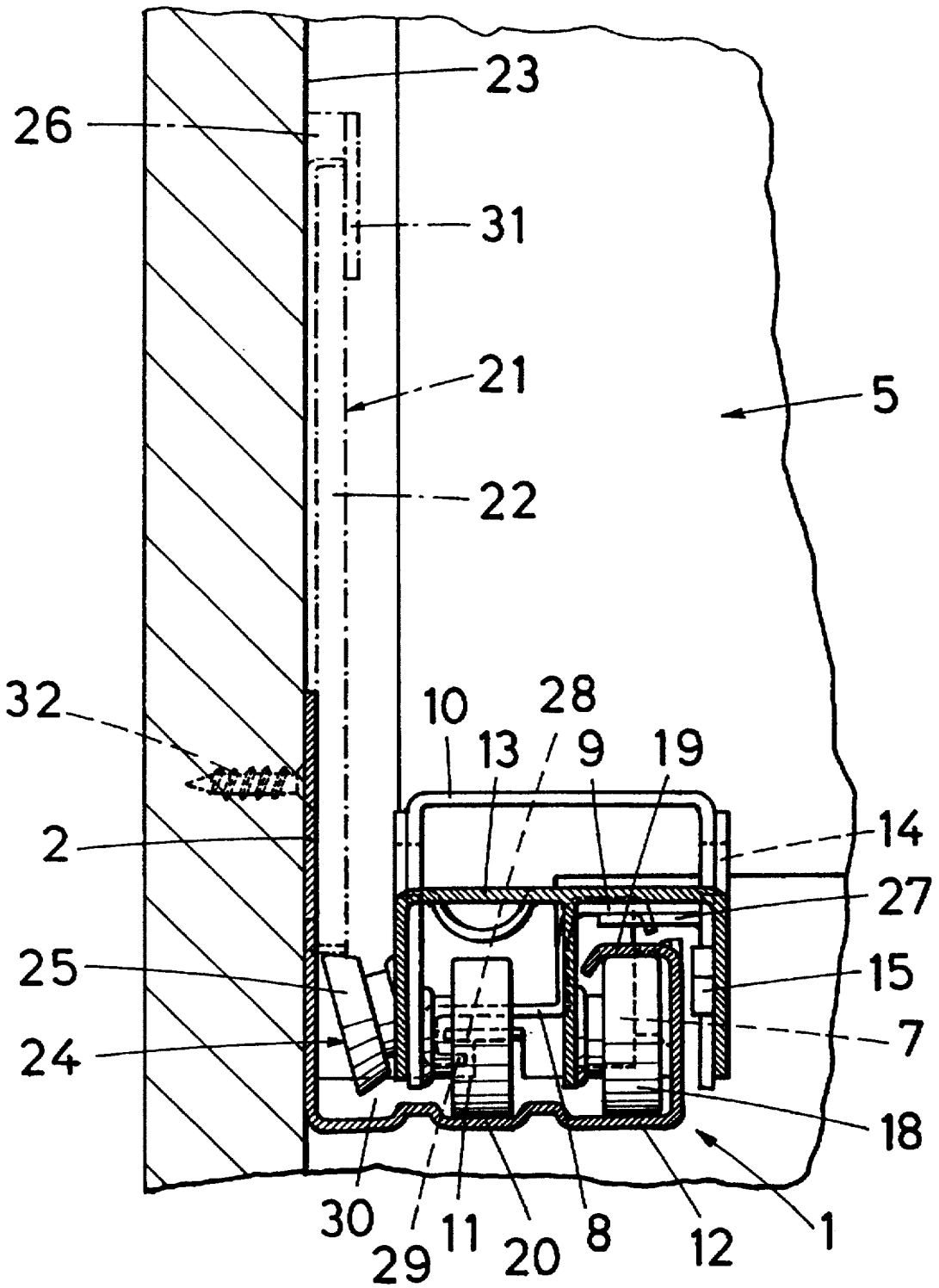
FIG. 5 illustrates a section along line V—V of FIG. 3, on an enlarged scale.

To ensure that the supporting lever 13 can be swung up into the rest position in accordance with FIG. 1 when the drawer 5 is pushed in, and can be swung down into the working position in accordance with FIG. 3 when the drawer is drawn out, a guide bracket 21 is associated with the guide rail 1 in the vicinity of the mounting flange 2, whose guide surface 22 is formed by a guiding web protruding towards the drawer 5, which guiding web protrudes into the space between the inner cabinet wall 23 and the side wall 6 of the drawer 5. With this guide bracket 21 cooperates a guiding member 24 of the supporting lever 13 in the form of a frusto-conical guiding roller 25, which in accordance with FIGS. 4 and 5 is supported in the supporting lever 13 with a downward inclination with respect to the mounting flange 2 of the guide rail 1. Since in addition the guiding web of the guide surface 22 has a corresponding inclination in cross-section, the guide surface 22 provides for a lateral guidance of the guiding roller 25, which prevents an escape of the guiding roller 25 from the guide bracket 21. By means of the spring 17, the guiding roller 25 is urged against the guiding surface 22 in the vicinity of the guide bracket while the drawer 5 is pushed in and drawn out, and the supporting lever 13 is gradually swung up and down, as is indicated in FIG. 2. The upper marginal web 19 of the guide rail 1 must be interrupted in this section, so that the supporting roller 18 cannot impede the swivel movement of the supporting lever 13. In the retracted end position, in which the supporting lever 13 has reached the upper rest position in accordance with FIG. 1, the guiding roller 25 of the supporting lever 13 rests against an end stop 26 of the guide bracket 21. When the drawer 5 is drawn out, the supporting lever 13 is swung down into the working position against the force of the spring 17 along the guide bracket 21, until the supporting roller 18 moves below the upper marginal web 19 of the guide rail, and the guiding roller 25 can roll off from the guide surface 22. The pull-out movement of the drawer will only be stopped when a limit stop 27 formed by an angled tongue of the end piece 10 abuts against the front track roller 7 of the guide rail 1. In this pull-out position the track roller 11 on the side of the drawer rail is located substantially beside the track roller 7 of the guide rail 1.

Figure 6:
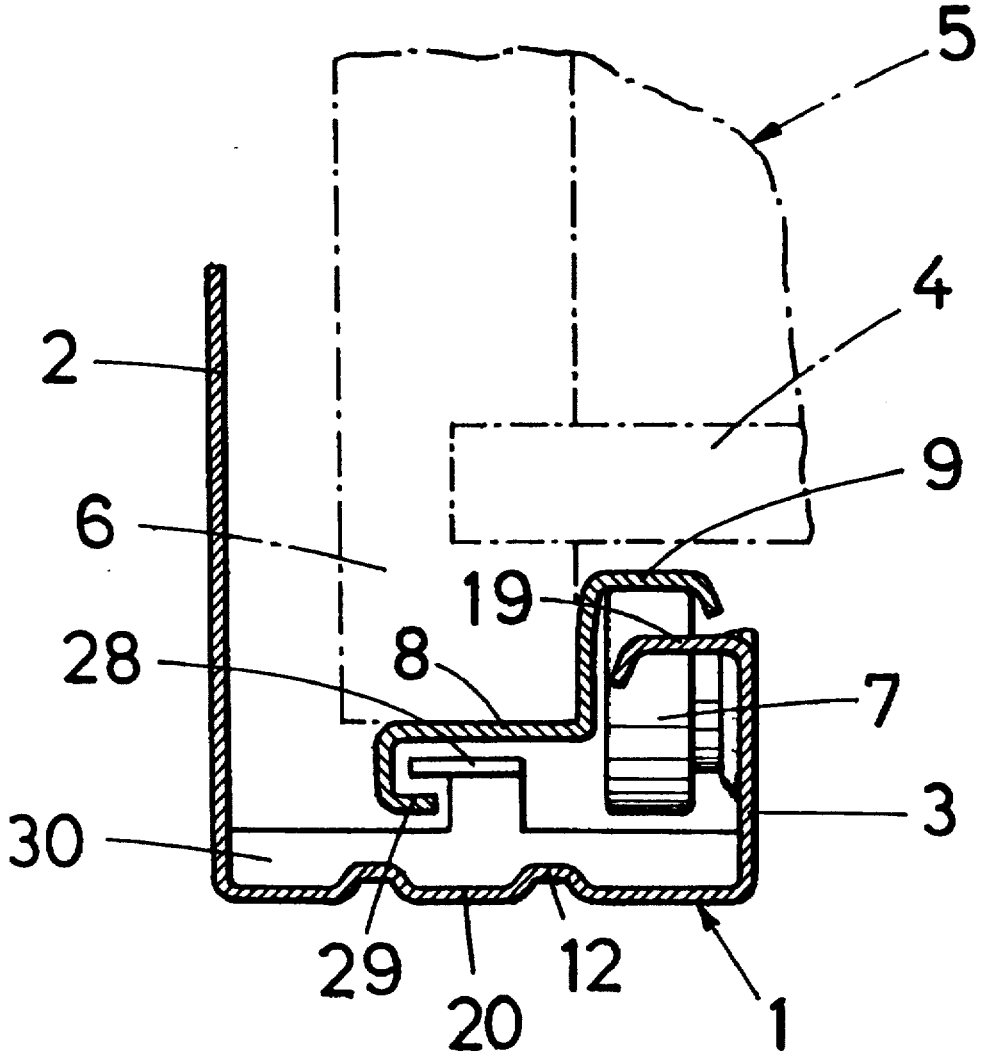
FIG. 6 illustrates a section along line VI—VI of FIG. 1, likewise on an enlarged scale.

The drawer rail 8 is prevented from being lifted off from the track roller 7 of the guide rail 1 by means of a safety stop 28, which engages over an angled marginal web 29 of the drawer rail 8, as illustrated in particular in FIG. 6. This safety stop 28 is formed by an inwardly bent lug of a front face wall 30, which connects the legs 2 and 3 of the guide rail 1 in the vicinity of the web.

For inserting the drawer 5, the drawer rail 8 must be introduced into the guide rail 1 such that the web 9 of the drawer rail 8 rests on the track roller 7 of the guide rail 1. To prevent the supporting roller 18 of the supporting lever 13 from being inserted behind the track roller 7 of the guide rail 1 below the upper marginal web 19, the supporting lever 13 remains in its rest position held by the spring 17. The consequence is, however, that the guiding member 24 can securely engage in the guiding bracket 21 when the drawer 5 is pushed in. For this purpose, a gripping guide 31 is provided before the guide bracket 21 in the upper portion of the guiding member 24 of the lifted supporting lever 13, which gripping guide protrudes beyond the guide surface 22 in accordance with FIGS. 4 and 5. Since as a result of the inherent elasticity of the lifted supporting lever 13 and the support thereof, the guiding member 24 of the gripping guide 31 can resiliently escape to the inside, so as to engage behind the gripping guide 31 formed by a guiding web, the subsequent pull-out of the drawer 5 will displace the guiding member 24 along the gripping guide 31 against the succeeding guide surface 22, into which it resiliently engages as a result of the remaining residual tension. The inclined position of the guiding roller 25 facilitates the movement past the gripping guide 31. If the inherent elasticity is not sufficient for a resilient escape of the guiding roller 25 in the vicinity of the gripping guide 31, guiding roller 25 could also be spring-loaded in axial direction. In any case, it must be ensured that in the lower working position the supporting lever 13 allows a sufficient lateral guidance of the drawer 5, which in general can easily be ensured with a corresponding stop position.

As can in particular taken from FIGS. 4 and 5, the fastening screws 32 are disposed outside the paths of movement of the supporting track and guiding rollers in the vicinity of the outer leg 2 of the guide rail 1, so that the performance of the sliding drawer cannot be impaired even if the screw heads protrude beyond the mounting flange. In addition, the freely accessible leg 2 of the guide rail 1 facilitates the assembly thereof.

I claim:

1. A sliding drawer guide for a drawer having a bottom wall and a rear wall, which comprises (a) a substantially U-shaped guide rail comprising
  (1) an outer leg forming a mounting flange,
  (2) an inner leg having an upper guiding web projecting towards the outer leg substantially perpendicularly to the inner leg, and
  (3) a lower guiding web connecting the outer and inner legs,
  (4) the guide rail having a front portion and a rear portion, (b) a drawer rail extending substantially inside the U-shaped guide rail and having a rear portion, the drawer rail being adapted to be mounted underneath the bottom wall, (c) a first track roller mounted on the inner leg of the guide rail in the front portion thereof and supporting the drawer rail, (d) a second track roller mounted on the drawer rail in the rear portion thereof and rolling on the lower guiding web of the guide rail, (e) a pivotal supporting lever being pivotal between an upper rest position and a lower, stop-limited working position, the pivotal supporting lever projecting beyond the rear wall of the sliding drawer when the drawer rail is mounted underneath the bottom wall, (f) a guide bracket arranged on the mounting flange at the rear portion of the guide rail for guidingly supporting the supporting lever, (g) a guiding member at a free end of the supporting lever, the guiding member engaging the guide bracket, and (h) a supporting roller cooperating with the upper guiding web of the inner leg of the guide rail.

2. The sliding drawer guide of claim 1, further comprising a spring biasing the supporting lever into the upper rest position.

3. The sliding drawer guide of claim 1, further comprising a gripping guide verging into the guide bracket and arranged at a level of the guiding member in the upper rest position of the supporting lever.

4. The sliding drawer guide of claim 3, wherein the gripping guide protrudes from the guide bracket.

5. The sliding drawer guide of claim 1, further comprising a stop for the guiding member of the supporting lever at an upper end of the guide bracket.

6. The sliding drawer guide of claim 1, wherein the guiding member of the supporting lever is a frusto-conical guiding roller engaged in the guide bracket.

7. The sliding drawer guide of claim 6, wherein the guiding roller is downwardly inclined with respect to the mounting flange of the guide rail.

8. The sliding drawer guide of claim 1, further comprising an end piece connectable with the drawer rail and forming a pivot bearing for the supporting lever, the second track roller being mounted on the end piece.

9. The sliding drawer guide of claim 8, wherein the end piece is adapted to be fixed to the rear wall of the drawer.

10. The sliding drawer guide of claim 1, wherein the drawer rail comprises an angled marginal web, and the guide rail comprises a safety stop at the front portion thereof, the angled marginal web of the drawer rail engaging the safety stop of the guide rail.

11. The sliding drawer guide of claim 1, wherein the second track roller is rollingly supported on the lower guiding web of the guide rail and is offset towards the mounting flange with respect to the first track roller.

* * * * *

UNITED STATES PATENT AND TRADEMARK OFFICE

CERTIFICATE OF CORRECTION

PATENT NO. : 5,895,102

DATED : April 20, 1999

INVENTOR(S) : Fleisch

It is certified that error appears in the above-indentified patent and that said Letters Patent is hereby corrected as shown below:

On the cover page, column 1, Item [30], line 2, change "1994" to --1996--.

Signed and Sealed this

Thirteenth Day of June, 2000

*Attest:*

*Attesting Officer*

Q. TODD DICKINSON

*Director of Patents and Trademarks*